US010716375B2

(12) United States Patent
Buechin et al.

(10) Patent No.: US 10,716,375 B2
(45) Date of Patent: Jul. 21, 2020

(54) FOLDING PROTECTIVE COVER FOR AN ELECTRONIC DEVICE

(71) Applicant: RAKUTEN KOBO INC., Toronto, Ontario (CA)

(72) Inventors: Anna Buechin, Toronto (CA); Archer Wun, Maple (CA); Kuan-Chang Lin, New Taipei (TW)

(73) Assignee: RAKUTEN KOBO INC., Toronto (CA)

( * ) Notice: Subject to any disclaimer, the term of this patent is extended or adjusted under 35 U.S.C. 154(b) by 0 days.

(21) Appl. No.: 16/165,637

(22) Filed: Oct. 19, 2018

(65) Prior Publication Data

US 2020/0121045 A1 Apr. 23, 2020

(51) Int. Cl.
*A45C 11/00* (2006.01)

(52) U.S. Cl.
CPC ..... *A45C 11/00* (2013.01); *A45C 2011/002* (2013.01); *A45C 2011/003* (2013.01); *A45C 2200/15* (2013.01)

(58) Field of Classification Search
CPC ..... A45C 11/00; A45C 2011/002; A45C 2011/003; A45C 2200/15; B65D 85/00
USPC ..... 206/320
See application file for complete search history.

(56) References Cited

U.S. PATENT DOCUMENTS 8,640,864 B2 * 2/2014 Chen ..... G06F 1/1626 206/320
9,049,911 B1 * 6/2015 Wood ..... A45C 11/00
9,226,559 B1 * 1/2016 Diebel ..... A45C 11/00
9,268,365 B2 * 2/2016 Chang ..... G06F 1/1633
9,310,835 B2 * 4/2016 Bryan ..... A45C 13/1069
9,326,404 B1 * 4/2016 Wood ..... A45C 11/00
9,332,813 B2 * 5/2016 Jiang ..... A45C 11/00
9,489,015 B2 * 11/2016 Gioscia ..... A45C 11/00
10,409,326 B2 * 9/2019 Buechin ..... A45C 11/00
2013/0020216 A1 * 1/2013 Chiou ..... G06F 1/1626 206/320

(Continued)

FOREIGN PATENT DOCUMENTS

CN 202959172 U * 6/2013
CN 203324884 U * 12/2013

(Continued)

OTHER PUBLICATIONS

International Search Report dated Dec. 12, 2019, issued in International Application No. PCT/JP2019/041230, 13 pages.

*Primary Examiner* — Bryon P Gehman
(74) *Attorney, Agent, or Firm* — XSENSUS LLP

(57) ABSTRACT

A protective case, including: a back cover and a front cover connected by a hinge. The front cover is divided into a five stiffener sections that are defined by four creases. The first and second stiffener sections are in a shape of a triangle. The second stiffener section is smaller in area than the first stiffener section. The third stiffener section is bordered by the second and third crease. The fourth stiffener section and the fifth stiffener section form a flap at an end of the front cover that is opposite the hinge, and the fourth stiffener section and the fifth stiffener section are the same size, and are separated by the fourth crease. An outer side of the front cover has a gap that is located between an angled edge of the fourth stiffener section and an angled edge of the fifth stiffener section.

13 Claims, 19 Drawing Sheets

(56) References Cited

U.S. PATENT DOCUMENTS

| | | | |
|---|---|---|---|
| 2013/0020214 | A1 | 2/2013 | Chiou |
| 2015/0296946 | A1 | 10/2015 | Buechin |

FOREIGN PATENT DOCUMENTS

| | | | |
|---|---|---|---|
| JP | 3178092 | U | 8/2012 |
| WO | 2018033796 | A1 | 2/2018 |

* cited by examiner

FOLDING PROTECTIVE COVER FOR AN ELECTRONIC DEVICE

BACKGROUND

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

Mobile computing devices, such as laptops, PDAs, media players, game consoles, touchpads, smartphones, e-readers etc., have evolved to become more and more sophisticated. With the rapidly developing technologies on Internet data storage, data transmission, and wireless communication as well as on data-handling capabilities of mobile computing devices, consumers increasingly spend extended time using such devices, such as watching videos, viewing photos, video conferencing, reading books, Internet browsing, sending emails, on-line chatting, playing video games, etc. To suit consumers' demand for portability, the design trend of various mobile computing devices continues to emphasize making the devices smaller and thinner. Most modern portable computing devices are installed with a touchscreen panel that is fixed to the device body. To view the display screen hands-free in an ergonomic view angle to reduce related visual discomforts, a user usually needs to position the device in an inclined angle (or an upright position) on a horizontal resting surface, e.g., a desk. Most mobile computing device products are not equipped with a built-in stand for supporting the device in an upright position. External accessories of various configurations are typically used to prop such a device in a user-intended orientation. In some of the accessory products, a stand is integrated with a protective case customized for a device model; while others are designed exclusively as a stand.

SUMMARY

The foregoing paragraphs have been provided by way of general introduction, and are not intended to limit the scope of the following claims. The described embodiments, together with further advantages, will be best understood by reference to the following detailed description taken in conjunction with the accompanying drawings.

An exemplary embodiment of the present disclosure provides a protective case. The protective case including: a back cover configured to secure an electronic reading device; and a front cover connected to the back cover by a hinge. The front cover is divided into a first stiffener section, a second stiffener section, a third stiffener section, a fourth stiffener section, and a fifth stiffener section that are defined by a first crease, a second crease, a third crease, and a fourth crease. The first stiffener section is in a shape of a triangle, and is bordered by the first crease, the second crease, and the hinge. The second stiffener section is in a form of a triangle, and is bordered by the first crease and the third crease, and the second stiffener section is smaller in area than the first stiffener section. The third stiffener section is the same shape and size as the second stiffener section, but is a mirror image of the second stiffener section, and the third stiffener section is bordered by the second crease and the third crease. The fourth stiffener section and the fifth stiffener section form a flap at an end of the front cover that is opposite the hinge, and the fourth stiffener section and the fifth stiffener section are the same size and are mirror images of each other, and are separated by the fourth crease. An outer side of the front cover has a gap that is located between an angled edge of the fourth stiffener section and an angled edge of the fifth stiffener section.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
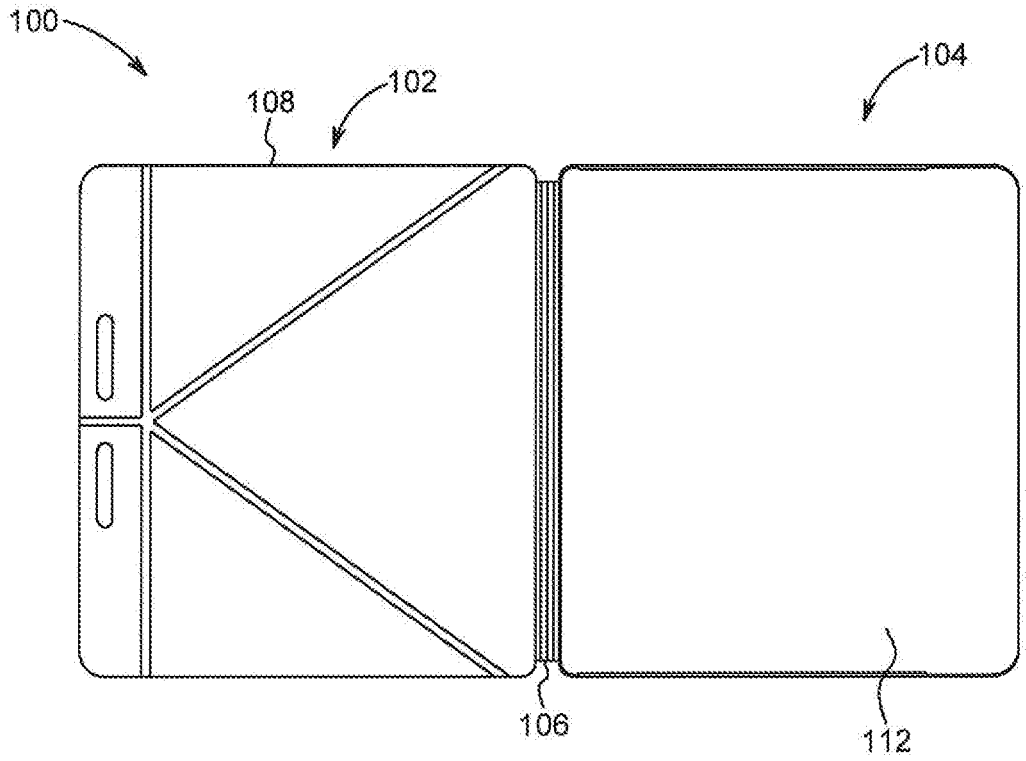
FIG. 1 depicts an exemplary overview of a protective case according to one or more aspects of the disclosed subject matter.

The description set forth below in connection with the appended drawings is intended as a description of various embodiments of the disclosed subject matter and is not necessarily intended to represent the only embodiment(s). In certain instances, the description includes specific details for the purpose of providing an understanding of the disclosed subject matter. However, it will be apparent to those skilled in the art that embodiments may be practiced without these specific details. In some instances, well-known structures and components may be shown in block diagram form in order to avoid obscuring the concepts of the disclosed subject matter.

Reference throughout the specification to "one embodiment" or "an embodiment" means that a particular feature, structure, characteristic, operation, or function described in connection with an embodiment is included in at least one embodiment of the disclosed subject matter. Thus, any appearance of the phrases "in one embodiment" or "in an embodiment" in the specification is not necessarily referring to the same embodiment. Further, the particular features, structures, characteristics, operations, or functions may be combined in any suitable manner in one or more embodiments. Further, it is intended that embodiments of the disclosed subject matter can and do cover modifications and variations of the described embodiments.

It must be noted that, as used in the specification and the appended claims, the singular forms "a," "an," and "the" include plural referents unless the context clearly dictates otherwise. That is, unless clearly specified otherwise, as used herein the words "a" and "an" and the like carry the meaning of "one or more." Additionally, it is to be understood that terms such as "left," "right," "top," "bottom," "front," "rear," "side," "height," "length," "width," "upper," "lower," "interior," "exterior," "inner," "outer," and the like that may be used herein, merely describe points of reference and do not necessarily limit embodiments of the disclosed subject matter to any particular orientation or configuration. Furthermore, terms such as "first," "second," "third," etc., merely identify one of a number of portions, components, points of reference, operations and/or functions as described herein, and likewise do not necessarily limit embodiments of the disclosed subject matter to any particular configuration or orientation.

Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Also, no claim element herein is to be construed under the provisions of 35 U.S.C. § 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

Referring now to the drawings, wherein like reference numerals designate identical or corresponding parts throughout the several views.

FIG. 1 depicts a front view of a protective case 100 when it is in an open position in accordance with an exemplary embodiment. The protective case 100 is designed as an accessory to protect a mobile computing device (e.g., electronic reading device, tablet, smartphone, etc.). The protective case 100 consists of a front cover 102 and a back cover 104 that are connected to each other by a folding hinge 106 that allows the front cover 102 and the back cover 104 to move relative to each other. FIG. 1 shows the inner side of the front cover 108 and the inner side of the back cover 112 (i.e., the portions of the protective case 100 that are in contact with an electronic reading device 624). An electronic reading device 624 is held and secured by the back cover 104, and the front cover 102 is a foldable flap that protects the display screen of the electronic reading device 624 in a covered position. The back cover 104 is non-foldable, and the electronic reading device 624 can be detachably affixed (snapped in) and secured to the back cover 104. The back cover 104 can be used to protect the back side of the electronic reading device 624.

Figure 2:
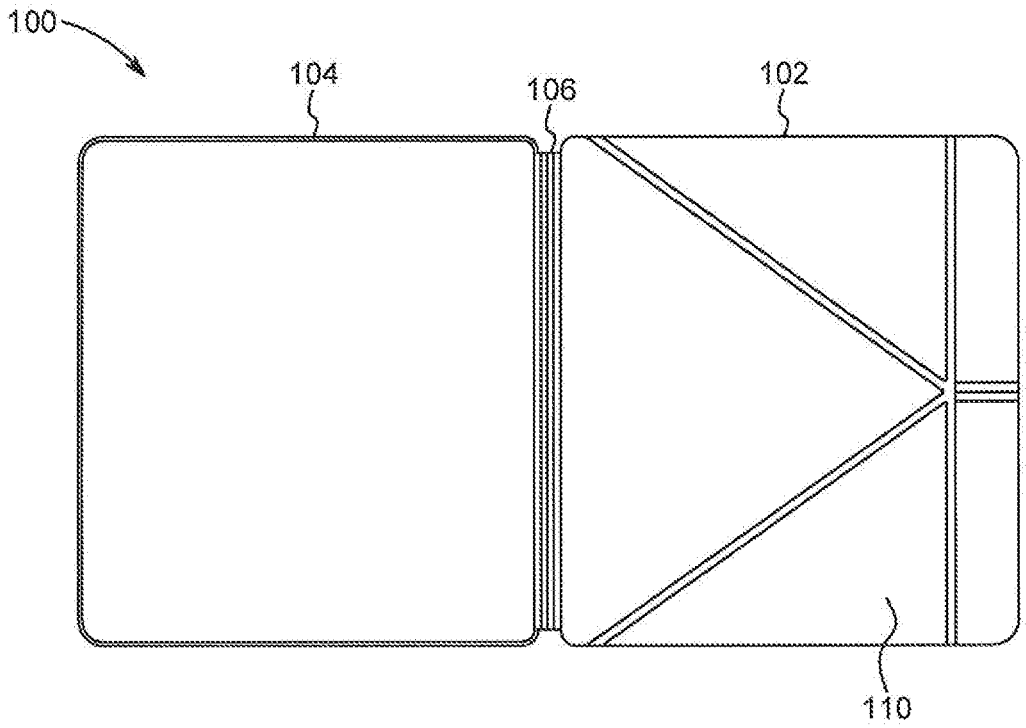
FIG. 2 depicts an exemplary overview of a protective case according to one or more aspects of the disclosed subject matter.

FIG. 2 depicts a back view of the protective case 100 when it is in the open position in accordance with an exemplary embodiment. FIG. 2 shows the outer side of the back cover 114 (which is identified in FIG. 3). In an exemplary embodiment, the height and width of the front cover 102 is the same as the height and width of the back cover 104. However, it is possible that the height and width of the front cover 102 is different (e.g., slightly different) than the height and width of the back cover 104.

Figure 3:
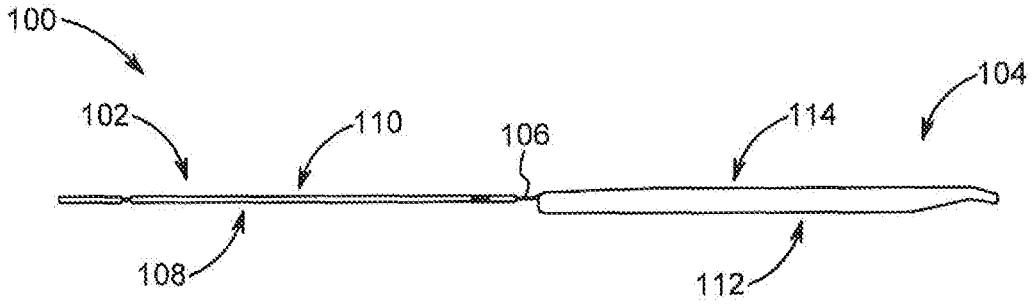
FIG. 3 depicts an exemplary overview of a protective case according to one or more aspects of the disclosed subject matter.

FIG. 3 depicts a top view of the protective case 100 when it is in an open position. FIG. 3 shows the inner side of the front cover 108 and the outer side of the front cover 110. This figure also shows the inner side of the back cover 112 and the outer side of the back cover 114.

Figure 4:
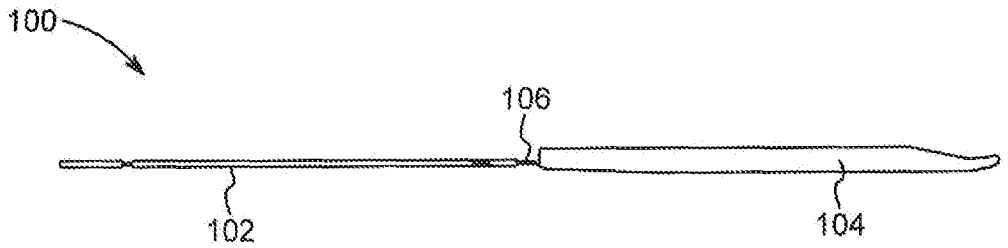
FIG. 4 depicts an exemplary overview of a protective case according to one or more aspects of the disclosed subject matter.
Figure 5:
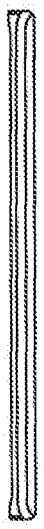
FIG. 5 depicts an exemplary overview of a protective case according to one or more aspects of the disclosed subject matter.

FIG. 4 depicts a bottom view of the protective case 100 when it is in an open position. FIG. 5 depicts a side view of the protective case 100 when it is in a closed position.

Figure 6:
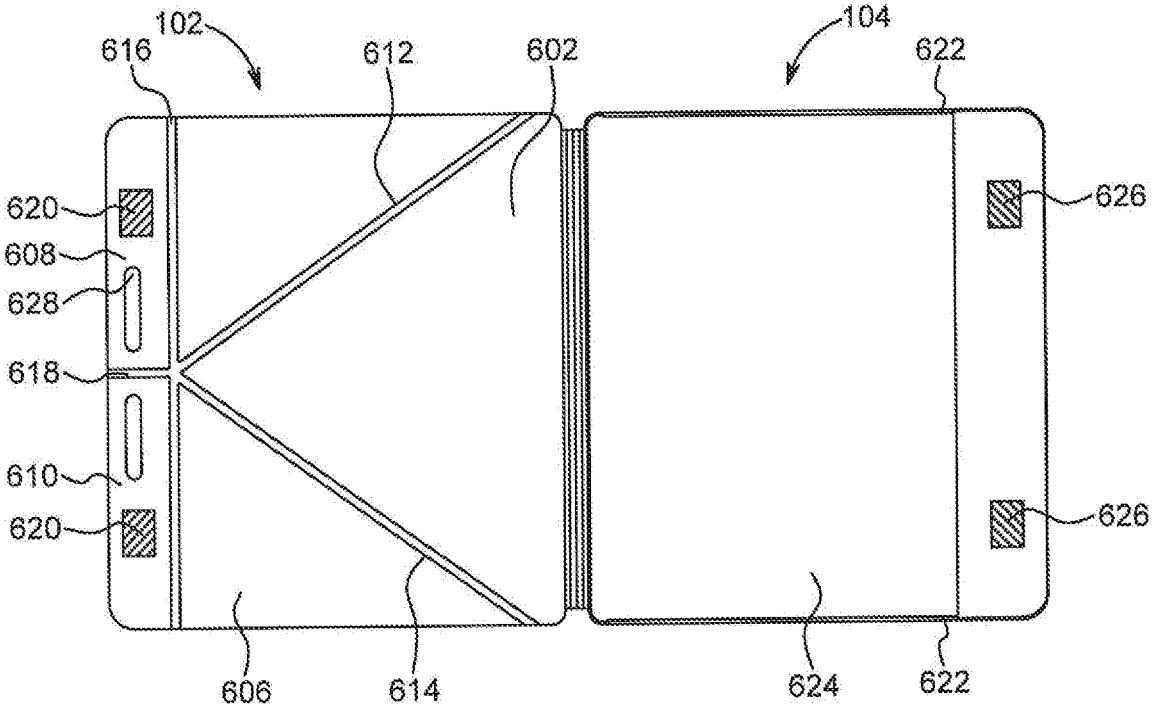
FIG. 6 depicts an exemplary overview of an electronic reading device with a protective case according to one or more aspects of the disclosed subject matter.

Referring now to FIG. 6, the back cover 104 is a molded plastic shell that has snaps 622 at the top and bottom edges of the back cover 104 that hold the electronic reading device 624 in place. That is, the back cover 104 with the snaps 622 is in the form of a tray, and the electronic reading device 624 snaps into the tray. The snaps 622 can be made of plastic, carbon fiber, metal, or any other material. In an exemplary embodiment, the back cover 104 is an injection molded plastic shell.

The folding hinge 106 is a soft spine without a substrate. The front cover 102 is divided into a plurality of portions by a plurality of creases and a fold/crease 618. In an exemplary embodiment, FIG. 6 shows that the front cover 102 is divided into five separate portions that are defined/separated by three creases and one fold 618. FIG. 6 shows that the front cover 102 is made up of a first stiffener section 602, a second stiffener section 604, a third stiffener section 606, a fourth stiffener section 608, and a fifth stiffener section 610. In an exemplary embodiment, each stiffener section 602, 604, 606, 608, and 610 is an injection molded polycarbonate material. FIG. 6 shows a first crease 612, a second crease 614, a third crease 616, and a fourth crease/fold 618. The first stiffener section 602 is in the shape of a triangle, and is bordered by the first crease 612, the second crease 614, and the folding hinge 106. The second stiffener section 604 is in the form of a triangle, and is bordered by the first crease 612 and the third crease 616. The second stiffener section 604 is smaller in area than the first stiffener section 602. The third stiffener section 606 is the same shape and size as the second stiffener section 604, but is a mirror image of the second stiffener section 604. The third stiffener section 606 is bordered by the second crease 614 and the third crease 616. The fourth stiffener section 608 and the fifth stiffener section 610 form a flap at the end of the front cover 102 that is opposite the folding hinge 106. The fourth stiffener section 608 and the fifth stiffener section 610 are the same size and are mirror images of each other. The fourth stiffener section 608 and the fifth stiffener section 610 are in the shape of a rectangle, but with one corner rounded off. The fourth stiffener section 608 and the fifth stiffener section 610 are separated by a fold 618, which will be described in detail later. The first crease 612, the second crease 614, the third crease 616, and the fold 618 allow the front cover 102 to be folded into a stand that supports and holds the electronic reading device 624 in one of several orientations. See FIGS. 12-14.

Figure 10:
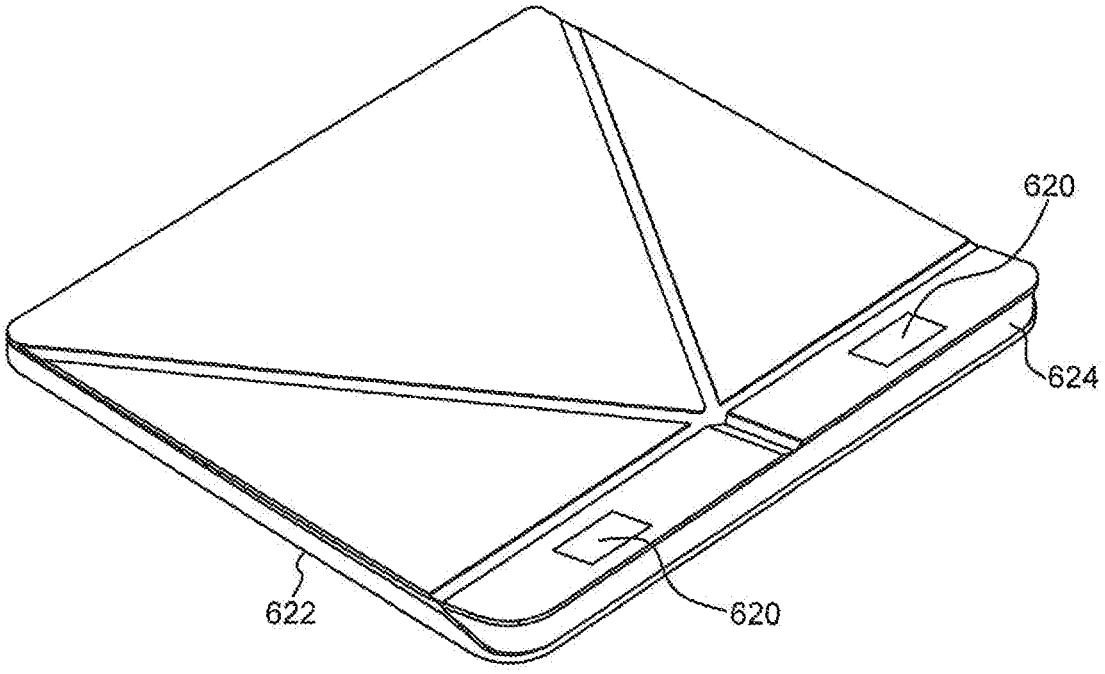
FIG. 10 depicts a view of a protective case in a closed position according to one or more aspects of the disclosed subject matter.

The electronic reading device 624 has one or more magnets 626 embedded in it that interact with/attach to two or more closure magnets 620 that are embedded in the front cover 104. In an exemplary embodiment, there are two magnets 626, and two closure magnets 620. As seen in FIG. 10, when the front cover 102 is closed, the two or more closure magnets 620 in the front cover 102 are in direct alignment with the one or more magnets 626 that are embedded in the electronic reading device 624. This keeps the front cover 102 closed. In FIG. 10, the third crease 616 enables the front cover 102 to fully close on top of the electronic reading device 624 which has an upward bend on the hand grip side. As seen in FIG. 6, one closure magnet 620 is located in the fourth stiffener section 608, and one closure magnet 620 is located in the fifth stiffener section 610. Each closure magnet 620 is equidistant from the fold 618. In an exemplar embodiment, each closure magnet 620 is rectangular in shape, and the long axis of the magnet 620 is parallel to the long axis of the fourth stiffener section 608 and the long axis of the fifth stiffener section 610. The device magnets 626 can be located in an extended housing portion of the electronic reading device 624 that is used for gripping the device with a user's hand.

As seen in FIG. 6, the front cover 102 has device button recesses 628 that accommodate raised buttons 1102 (e.g., page turn buttons) on the front surface of the electronic reading device 624. In an exemplary embodiment, there are two device button recesses 628, and one device button recess 628 is located in the fourth stiffener section 608, and the other device button recess 628 is located in the fifth stiffener section 610. In an exemplary embodiment, the device button recess 628 are located close to the fold 618, and the longitudinal axis of each device button recess 628 is parallel to the third crease 616. The device button recesses 628 are not visible from the outer side of the front cover 110.

Figure 7:
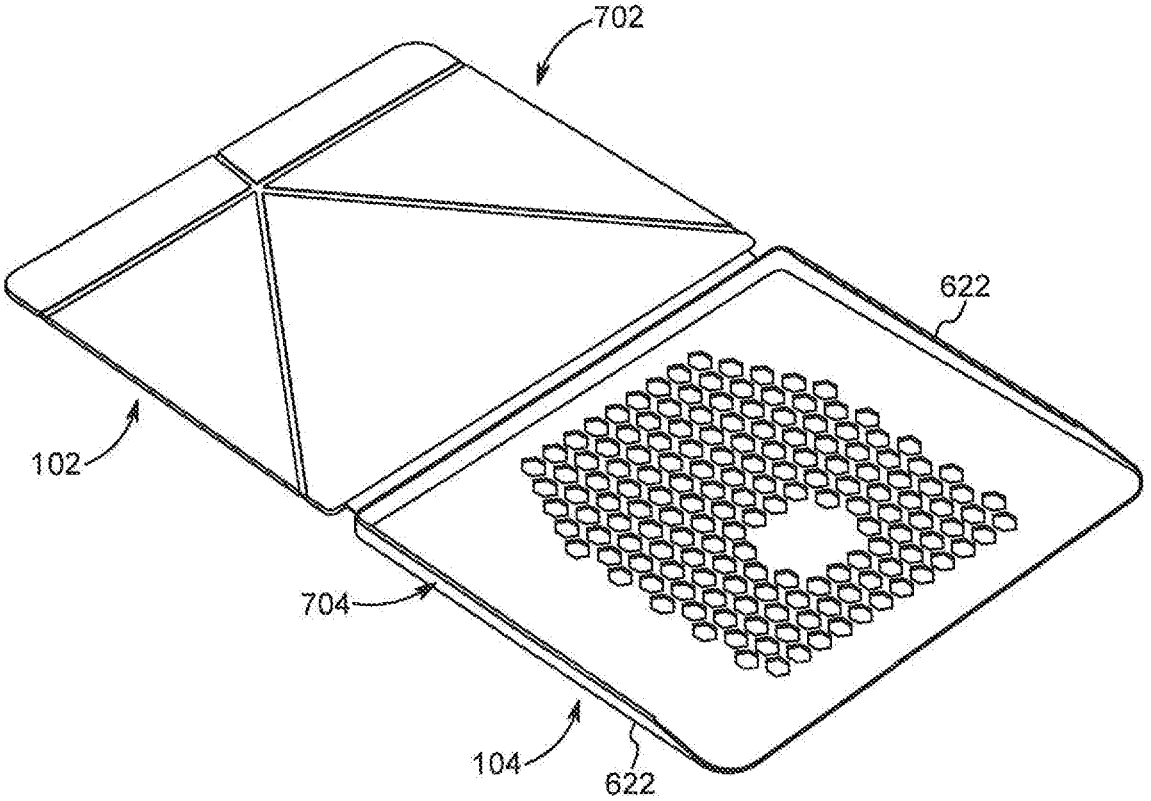
FIG. 7 depicts a perspective view of inner portions of a protective case according to one or more aspects of the disclosed subject matter.

The front cover 102 can be covered with soft materials. In an exemplary embodiment, the inner side of the front cover 108 is covered with a microfiber material. The outer side of the front cover 110 is covered with polyurethane (PU) leather. In FIG. 7, the front flap 102 has edges 702 that are wrapped with, for example, PU leather. In an exemplary embodiment, the PU leather edges 702 of the front cover 110 are covered by a microfiber lining. In an exemplary embodiment, the back cover edges 704 are plastic and are not covered with a soft material. As seen in FIG. 7, the weight of the back cover 104 is reduced by including a plurality of indentations (i.e., removed portions) on the surface of the back cover 104 that will be in contact with the electronic device 624. For example, the plurality of indentations can be a honeycomb structure that allows for the removal of material, while providing structural strength.

Figure 8:
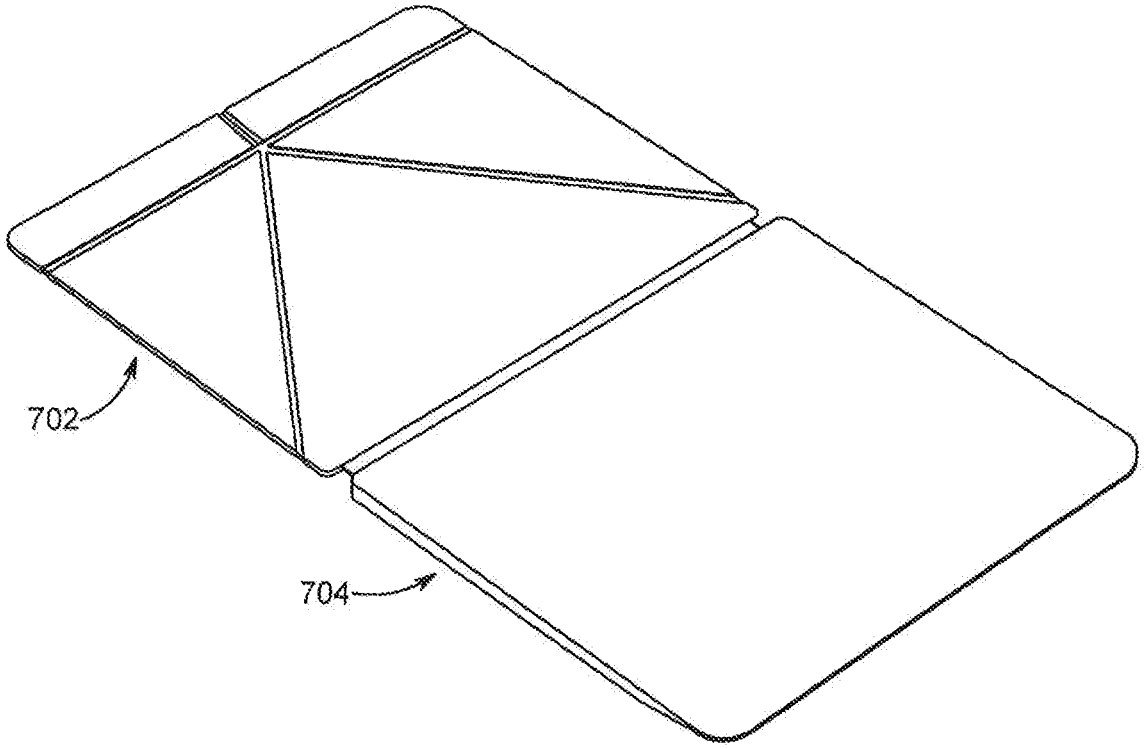
FIG. 8 depicts a perspective view of outer portions of a protective case according to one or more aspects of the disclosed subject matter.

As seen in FIG. 8, the outer side of the back cover 114 is covered with, for example, PU leather. The PU leather is laminated to the plastic shell (inset into the plastic shell). In an exemplary embodiment, the inner side of the back cover 112 is bare plastic. In an exemplary embodiment, the inner side of the back cover 112 is plastic that has a one or more layers of paint thereon.

Figure 9:
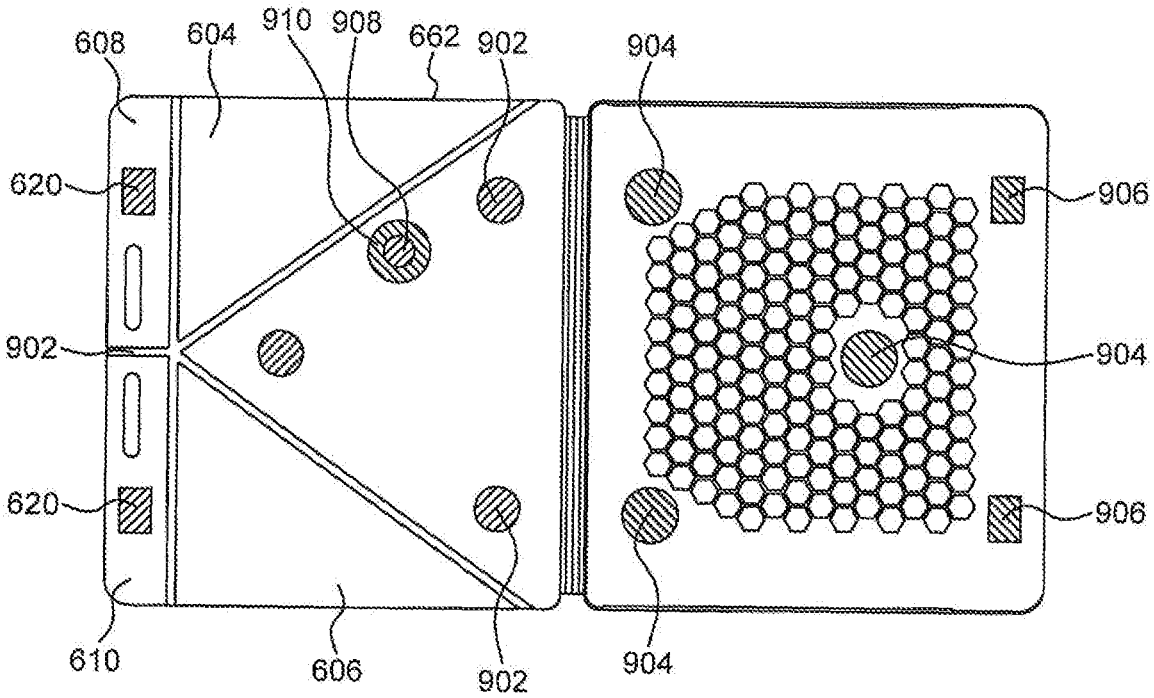
FIG. 9 depicts a view of inner portions of a protective case according to one or more aspects of the disclosed subject matter.

FIG. 9 shows the placement of various magnets and plates within the protective case 100. FIG. 9 shows the closure magnets 620 that were previously explained in relation to FIG. 6. In addition to the closure magnets 620, the front cover 102 has a plurality of embedded stand magnets 902. In an exemplary embodiment, there are three stand magnets 902. However, there could be two, four, five, or any number of stand magnets 902. The back cover 104 has a plurality of corresponding stand plates 904 that are embedded in the back cover 104. In an exemplary embodiment, the stand plates 904 are made of metal (e.g., steel). In an exemplary embodiment, there are three stand plates 904. However, there could be two, four, five, or any number of stand plates 904. The stand plates 904 interact with/attach to the stand magnets 902 that are embedded in the front cover 102 when the front cover 102 is folded into a stand.

Figure 11A:
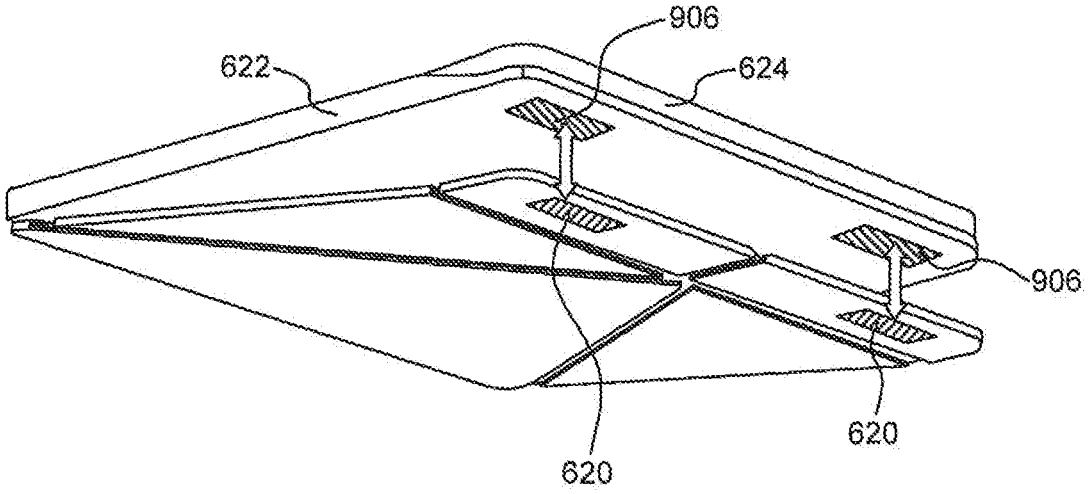
FIG. 11A depicts a view of a protective case with a portion of the protective case folded behind an electronic reading device according to one or more aspects of the disclosed subject matter.
Figure 11B:
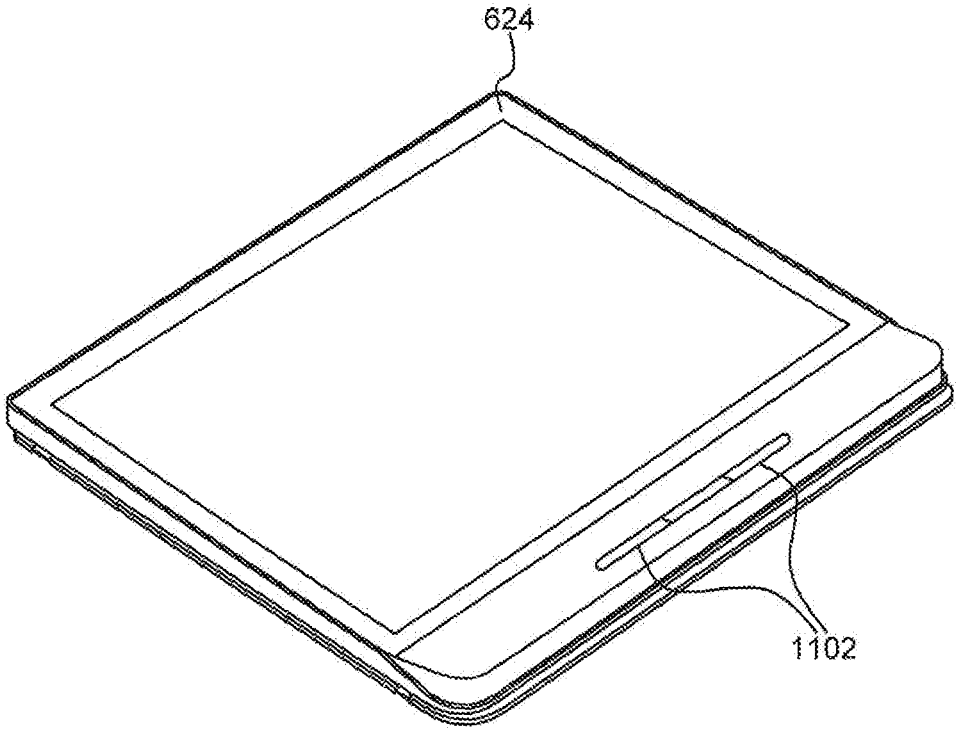
FIG. 11B depicts a view of a protective case with a portion of the protective case folded behind an electronic reading device according to one or more aspects of the disclosed subject matter.

As seen in FIGS. 9 and 11A, the back cover 104 has back cover plates 906 that are embedded in the molded plastic shell. In an exemplary embodiment, the back cover plates 906 are made of metal (e.g., steel). The back cover plates 906 interact with/attach to the closure magnets 620 that are embedded in the front cover 102 when the front cover 102 is folded behind the back cover 104 for reading as shown in FIGS. 11A and 11B.

As seen in FIG. 9, the front cover 104 also has an embedded Hall sensor magnet 908. When the front cover 104 is closed and is next to the display screen, the Hall sensor magnet 908 interacts with a Hall sensor in the electronic reading device 624 causing the electronic reading device 624 to enter a sleep mode. Also, the electronic reading device 624 wakes up when the front cover 104 is opened. The Hall sensor magnet 908 has magnet shielding 910 so that the electronic reading device 624 does not enter the sleep mode when the front cover 104 is folded behind the back cover 104 for reading.

Figure 12:
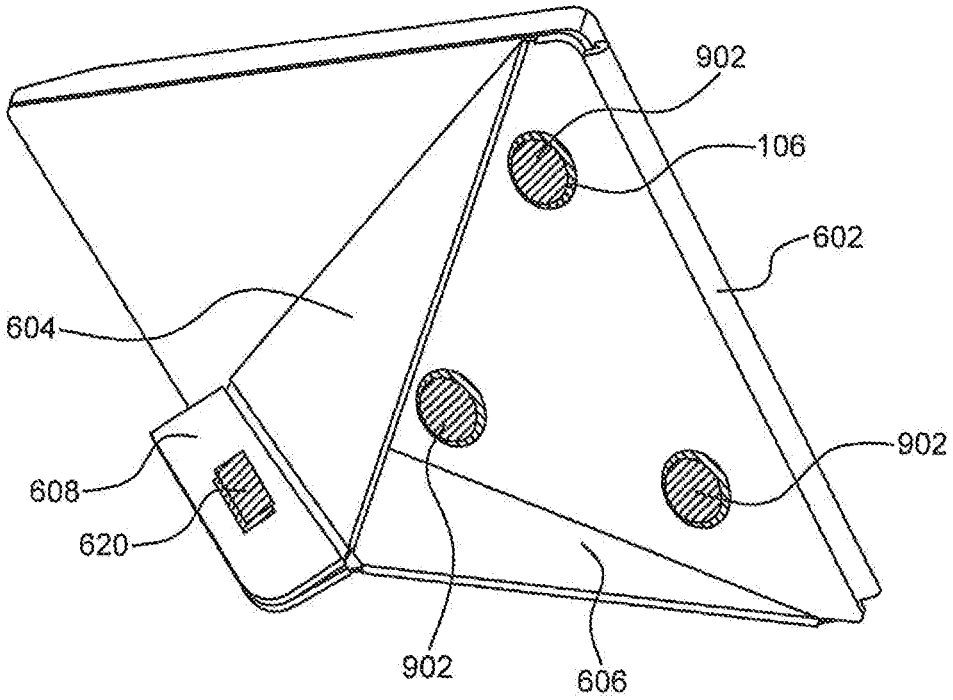
FIG. 12 depicts a view of a protective case when portions of the protective case are folded to create a stand according to one or more aspects of the disclosed subject matter.
Figure 13:
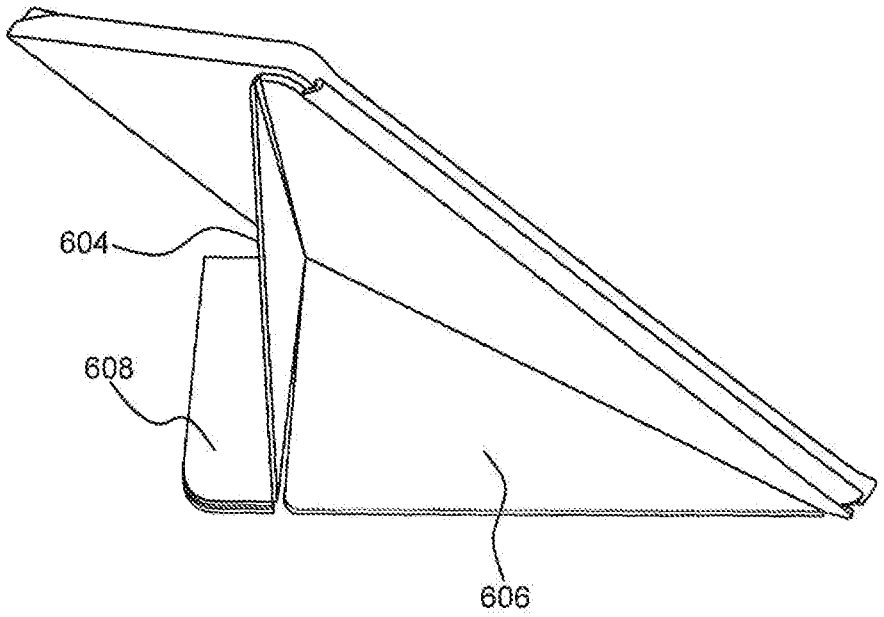
FIG. 13 depicts a view of a protective case when portions of the protective case are folded to create a stand according to one or more aspects of the disclosed subject matter.
Figure 14:
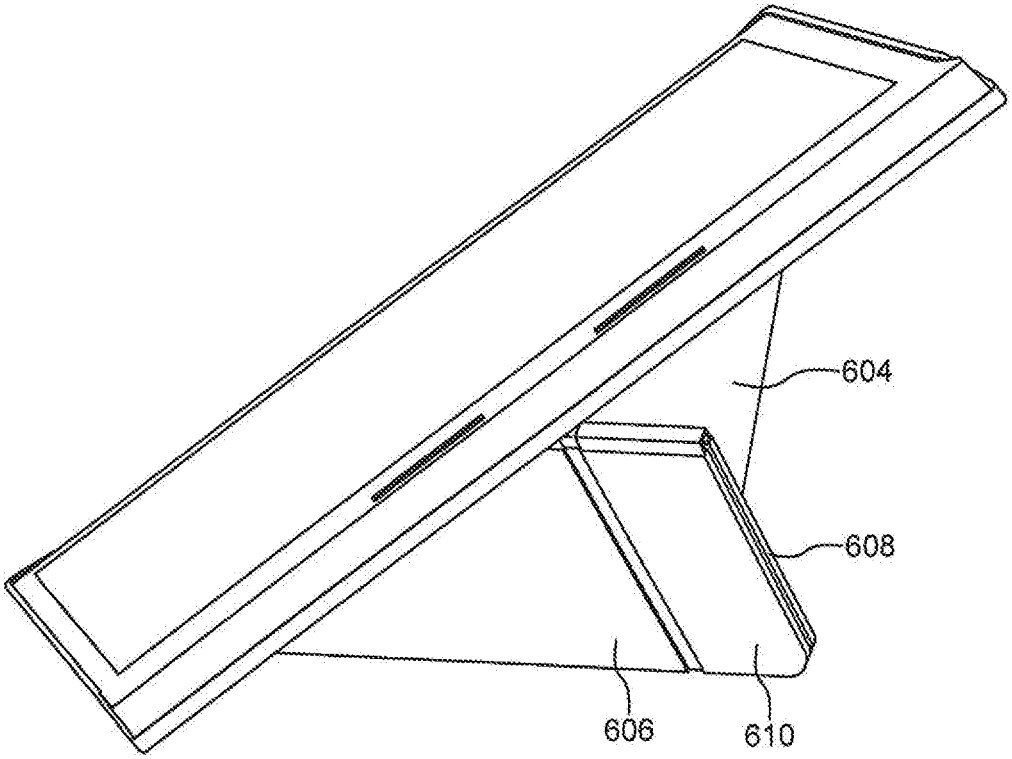
FIG. 14 depicts a view of a protective case when portions of the protective case are folded to create a stand according to one or more aspects of the disclosed subject matter.
Figure 15A:
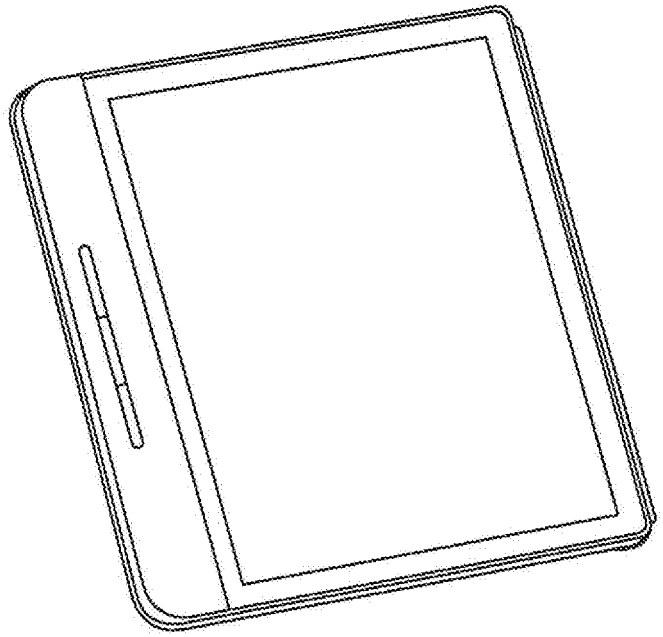
FIG. 15A depicts a view of an electronic reading device coupled with a protective case, and the electronic reading device is supported and held by the protective case in a vertical orientation.
Figure 15B:
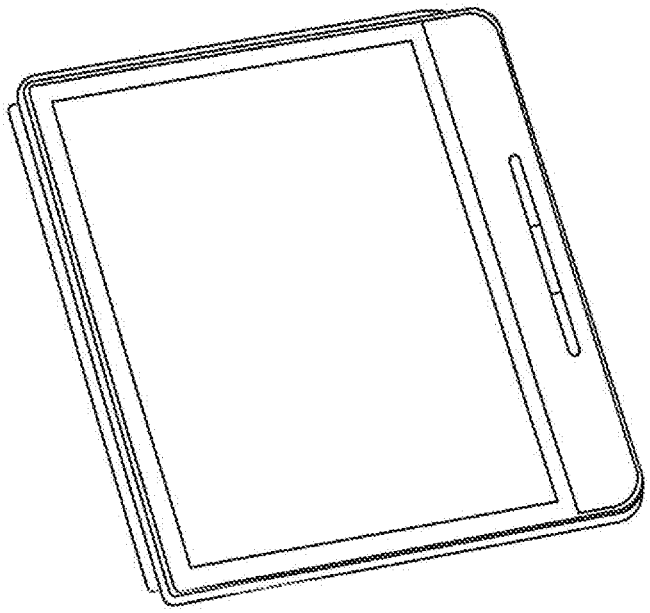
FIG. 15B depicts a view of an electronic reading device coupled with a protective case, and the electronic reading device is supported and held by the protective case in a vertical orientation.
Figure 15C:
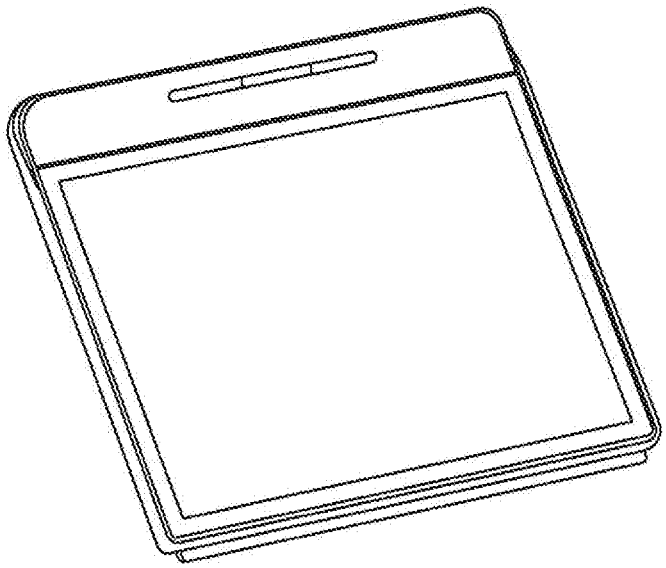
FIG. 15C depicts a view of an electronic reading device coupled with a protective case, and the electronic reading device is supported and held by the protective case in a horizontal orientation.
Figure 15D:
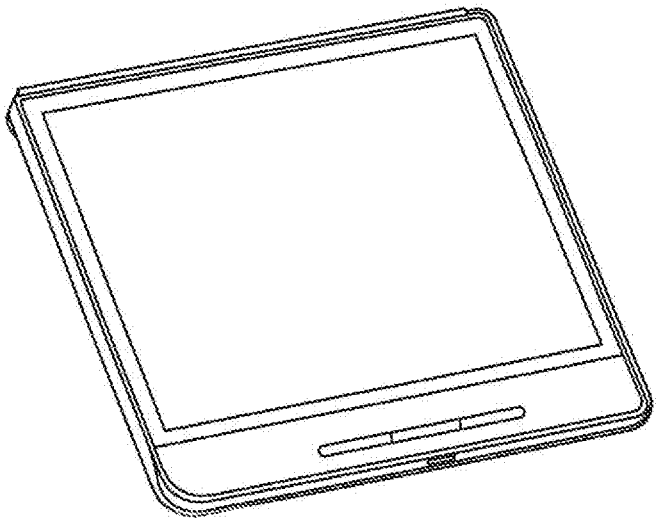
FIG. 15D depicts a view of an electronic reading device coupled with a protective case, and the electronic reading device is supported and held by the protective case in a horizontal orientation.

FIGS. 12, 13, and 14 show the front cover 102 folded into a stand. In FIG. 12, the first stiffener section 602 attaches to the back cover 102 due to the interactions between the plurality of stand magnets 902 embedded in the front cover and the plurality of stand plates 904 that are embedded in the back cover 104. In this position, each of the plurality of stand magnets 902 are aligned with a corresponding stand plate 904. The second stiffener section 604 is folded back along the first crease 612, and the third stiffener section 606 is folded back along the second crease 614. The edge of the second stiffener section 604 that is in contact with the third crease 616 and the edge of the third stiffener section 606 that is in contact with the third crease 616 are in contact with each other and held together by the closure magnets 620. Specifically, the closure magnet 620 in the fourth stiffener section 608 and the closure magnet 620 in the fifth stiffener section 610 attach to each other so that the fourth stiffener section 608 is folded upon the fifth stiffener section 610 due to the fold 618. Once the front cover 102 is in the folded configuration just described, the protective case 100 enclosing the electronic reading device 624 can be placed in the vertical stand orientations shown in FIGS. 15A and 15B, and in the horizontal stand orientations shown in FIGS. 15C and 15D. FIGS. 13 and 14 show the configuration of the folded front cover 102 when the stand is in the vertical orientation shown in FIG. 15B. When the folding hinge 106 is placed on a flat surface when the folding front cover 102 is in the stand configuration shown in FIG. 12, the stand will be in the horizontal orientation shown in FIG. 15C.

Figure 16:
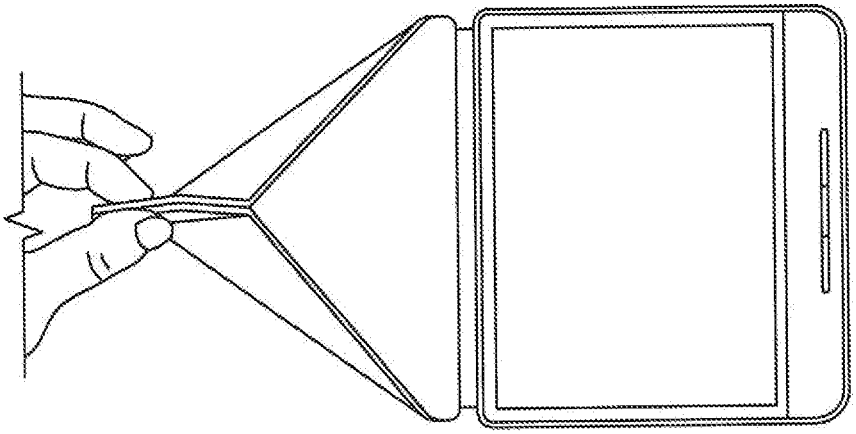
FIG. 16 depicts a view of a correct folding direction of a portion of a protective case according to one or more aspects of the disclosed subject matter.
Figure 17:
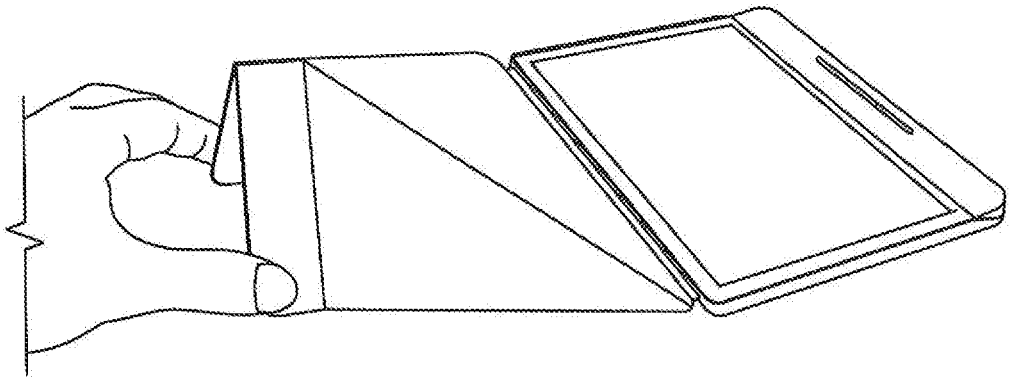
FIG. 17 depicts a view of an incorrect folding direction of a portion of a protective case according to one or more aspects of the disclosed subject matter.
Figure 18:
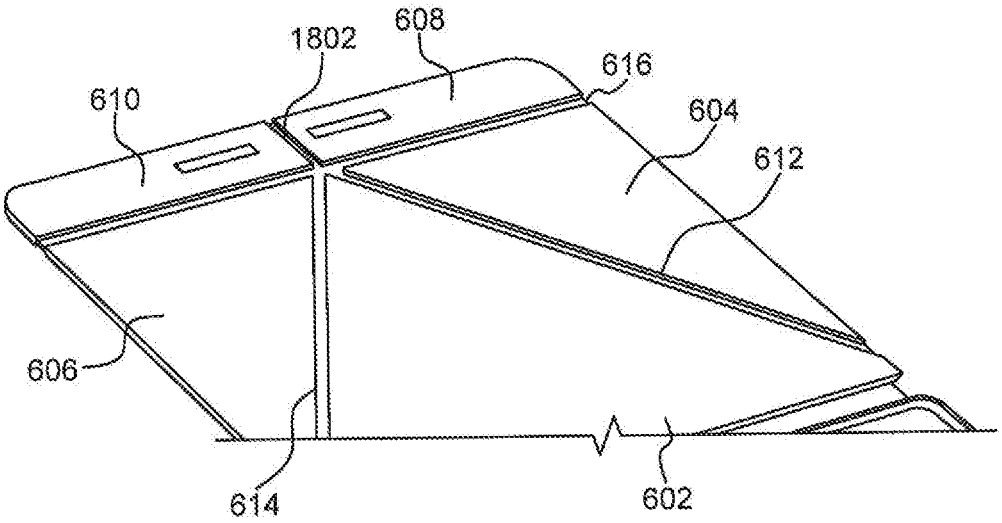
FIG. 18 depicts a perspective view of an inner side of a cover flap of a protective case according to one or more aspects of the disclosed subject matter.
Figure 19:
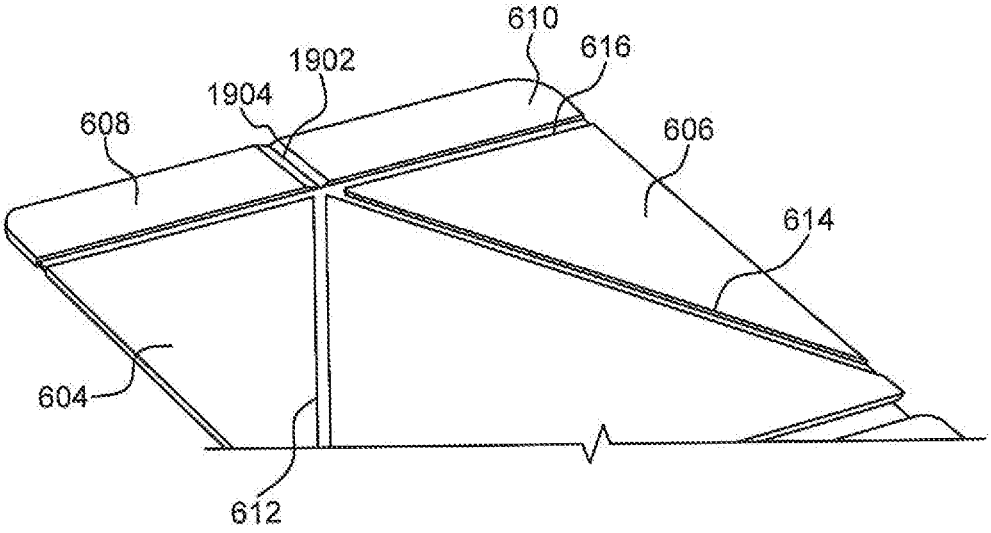
FIG. 19 depicts a perspective view of an outer side of a cover flap of a protective case according to one or more aspects of the disclosed subject matter.
Figure 20A:
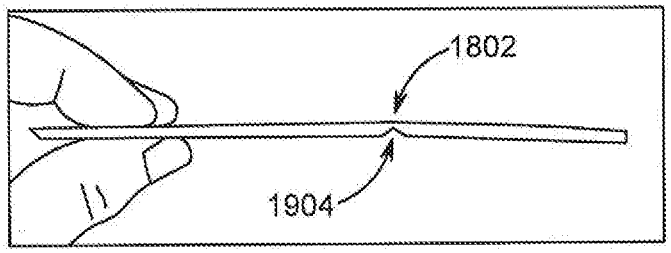
FIG. 20A depicts a view of the structure of material used in a portion of a cover flap of a protective case according to one or more aspects of the disclosed subject matter.
Figure 20B:
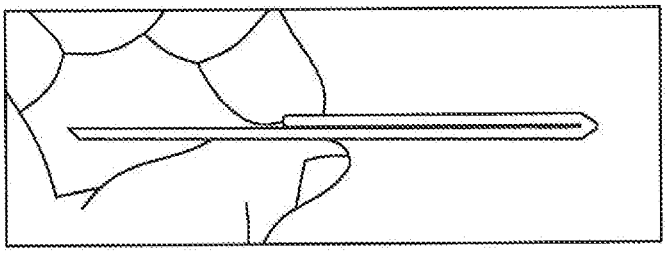
FIG. 20B depicts a view of the structure of material used in a portion of a cover flap of a protective case according to one or more aspects of the disclosed subject matter.
Figure 20C:
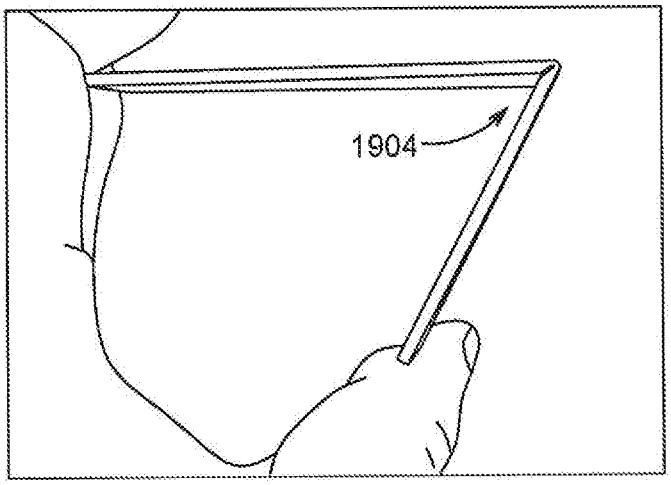
FIG. 20C depicts a view of the structure of material used in a portion of a cover flap of a protective case according to one or more aspects of the disclosed subject matter.

There is one correct direction to fold the fourth stiffener section 608 and the fifth stiffener section 610 about the fold 618. The correct folding direction is shown in FIG. 16, and the incorrect folding direction is shown in FIG. 17. To prevent users from folding the flaps in the incorrect direction and failing to make the stand, the fold 618 can be folded fully towards the inner side of the front cover 108 (i.e., the side of the front cover with microfiber), but cannot be folded fully towards the outer side of the front cover 110 (i.e., the side of the front cover with PU leather). As seen in FIG. 18, the inner side of the front cover 108 has a front cover inside gap 1802 that is narrow and located in between the fourth stiffener section 608 and the fifth stiffener section 610. It is the narrow front cover inside gap 1802 that allows for the correct full folding of the fourth stiffener section 608 and the fifth stiffener section 610. See FIGS. 20A and 20B. As seen in FIG. 19, the outer side of the front cover 110 has a front cover outside gap 1902 that is wider than the front cover inside gap 1802 due to angled edges (chamfer) of the fourth stiffener section 608 and the fifth stiffener section 610. In an exemplary embodiment, the angled edges can be 45 degrees relative to the vertical. However, the angled edges can be any number of degrees relative to the vertical (e.g., between 30 and 60 degrees). The angled edges of the fourth stiffener section 608 and the fifth stiffener section 610 prevent the folding of these two stiffener sections as shown in FIG. 20C.

Figure 21:
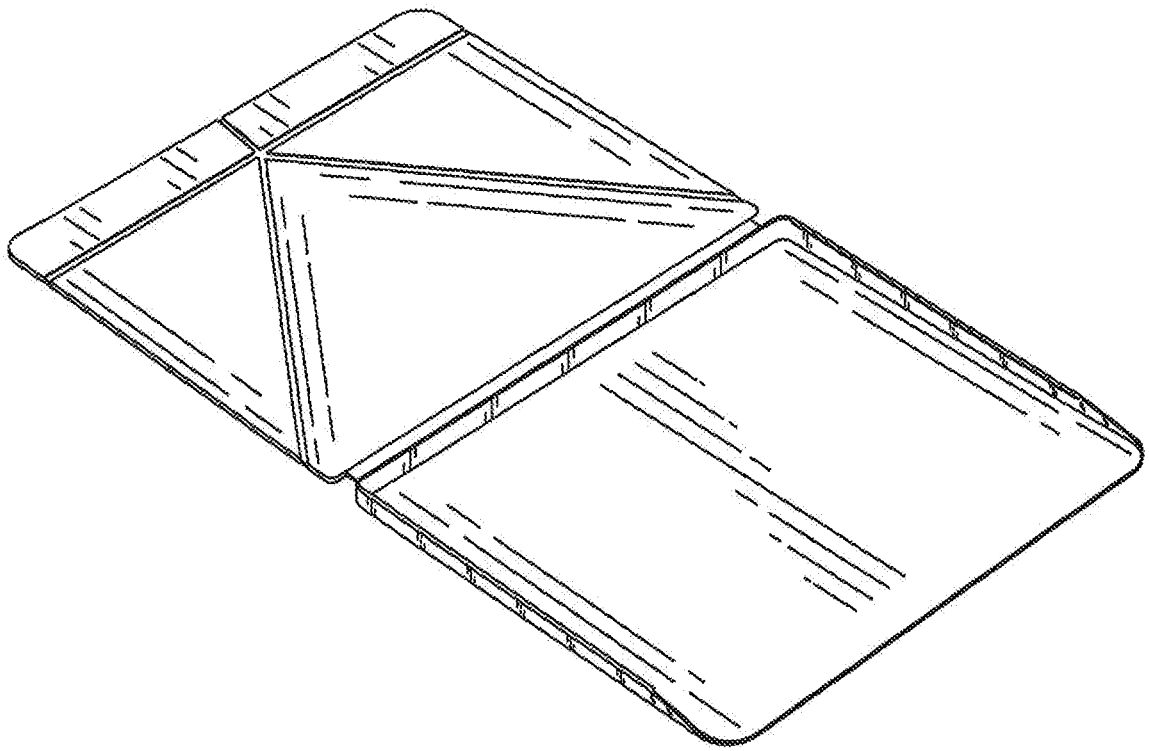
FIG. 21 depicts a perspective view of inner portions of a protective case according to one or more aspects of the disclosed subject matter.
Figure 22:
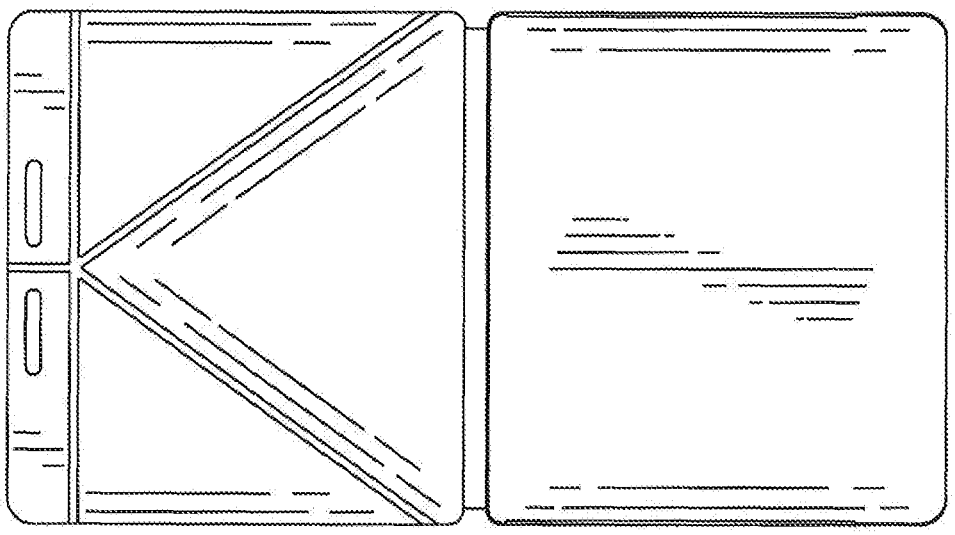
FIG. 22 depicts a perspective view of inner portions of a protective case according to one or more aspects of the disclosed subject matter.
Figure 23:
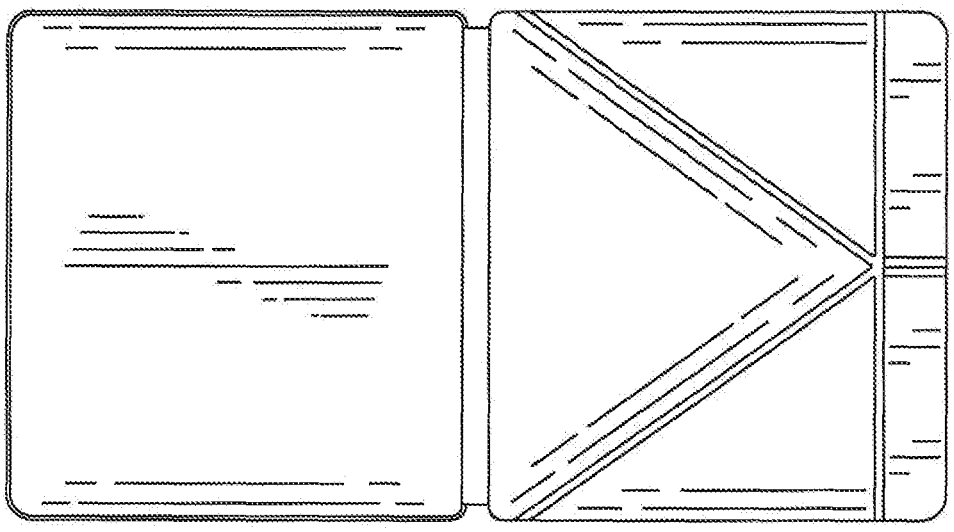
FIG. 23 depicts a perspective view of outer portions of a protective case according to one or more aspects of the disclosed subject matter.

FIGS. 21-33 illustrate various design features. FIG. 21 depicts a perspective view of inner portions of a protective case according to an exemplary embodiment. FIG. 21 does not show the device button recesses 628. FIGS. 22 and 23 show an exemplary embodiment. FIG. 22 depicts a perspective view of inner portions of a protective case, and FIG. 23 depicts a perspective view of outer portions of the protective case. In FIGS. 22 and 23, the protective case includes the device button recesses 628, the first crease 612, the second crease 614, the third crease 616, and the fold 618.

Figure 24:
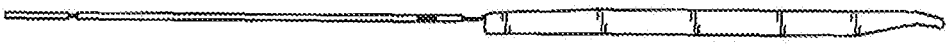
FIG. 24 depicts a perspective top view of a protective case according to one or more aspects of the disclosed subject matter.
Figure 25:
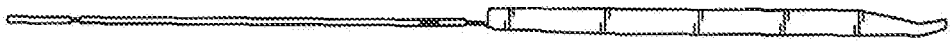
FIG. 25 depicts a perspective bottom view of a protective case according to one or more aspects of the disclosed subject matter.
Figure 26:
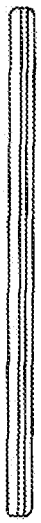
FIG. 26 depicts a perspective view of a side of a protective case according to one or more aspects of the disclosed subject matter.
Figure 27:
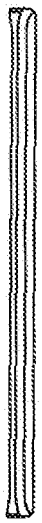
FIG. 27 depicts a perspective view of a side of a protective case according to one or more aspects of the disclosed subject matter.

FIG. 24 depicts a perspective top view of a protective case according to an exemplary embodiment. FIG. 25 depicts a perspective bottom view of a protective case according to an exemplary embodiment. FIG. 26 depicts a perspective view of a side of a protective case according to an exemplary embodiment. FIG. 27 depicts a perspective view of a side of a protective case according to an exemplary embodiment.

Figure 28:
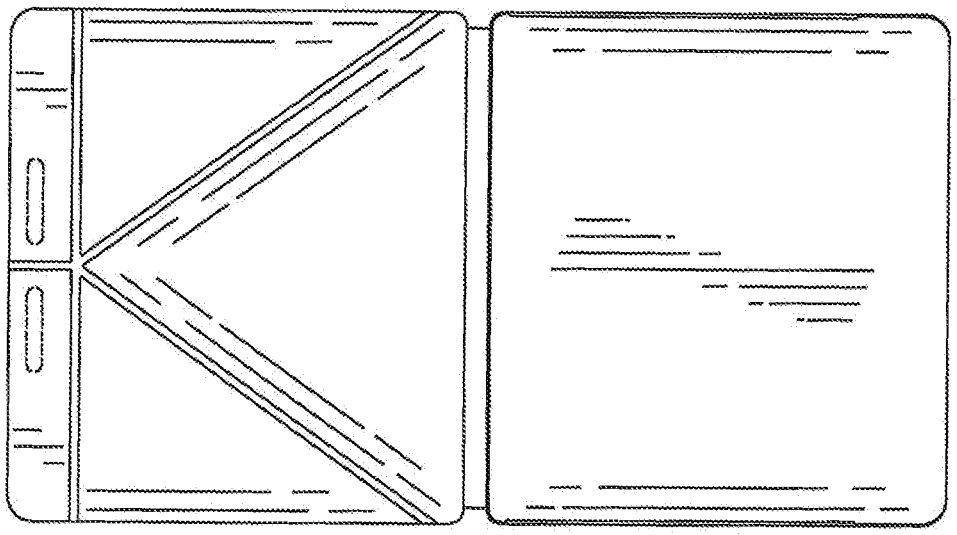
FIG. 28 depicts a perspective view of inner portions of a protective case according to one or more aspects of the disclosed subject matter.

FIG. 28 depicts a perspective view of inner portions of a protective case according to an exemplary embodiment. In FIG. 28, the device button recesses are optional.

Figure 29:
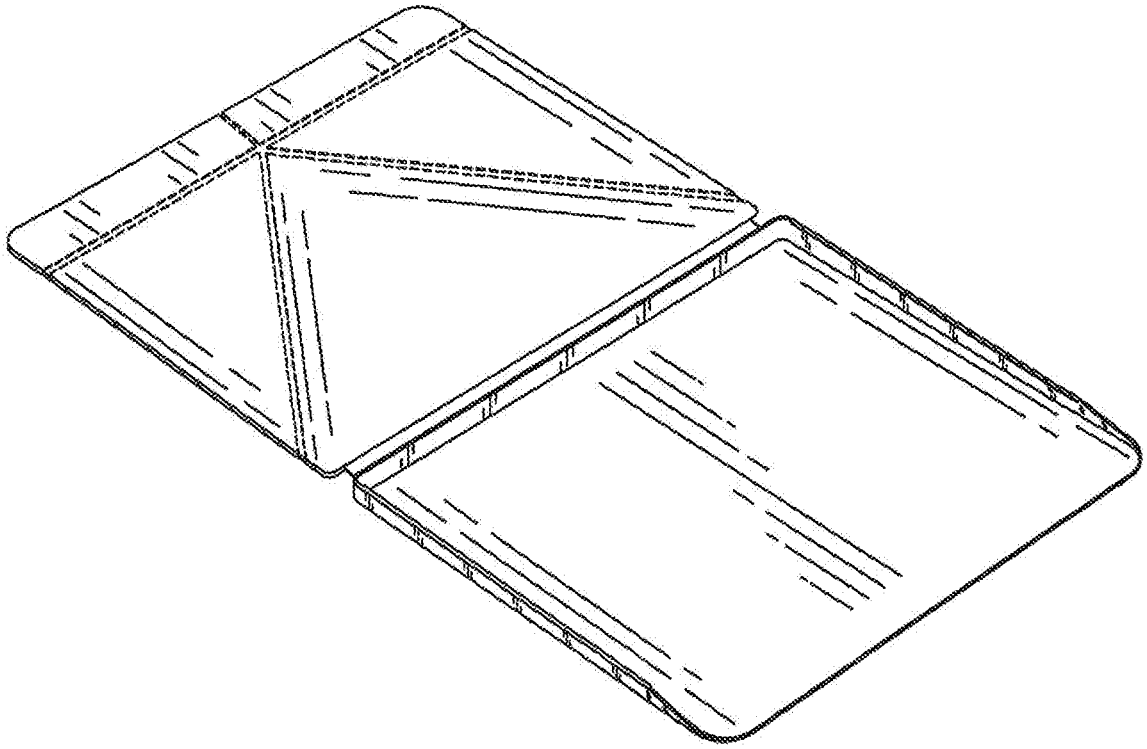
FIG. 29 depicts a perspective view of inner portions of a protective case according to one or more aspects of the disclosed subject matter.

FIG. 29 depicts a perspective view of inner portions of a protective case according to an exemplary embodiment. In FIG. 29, the first crease 612, the second crease 614, the third crease 616, and the fold 618 are optional.

Figure 30:
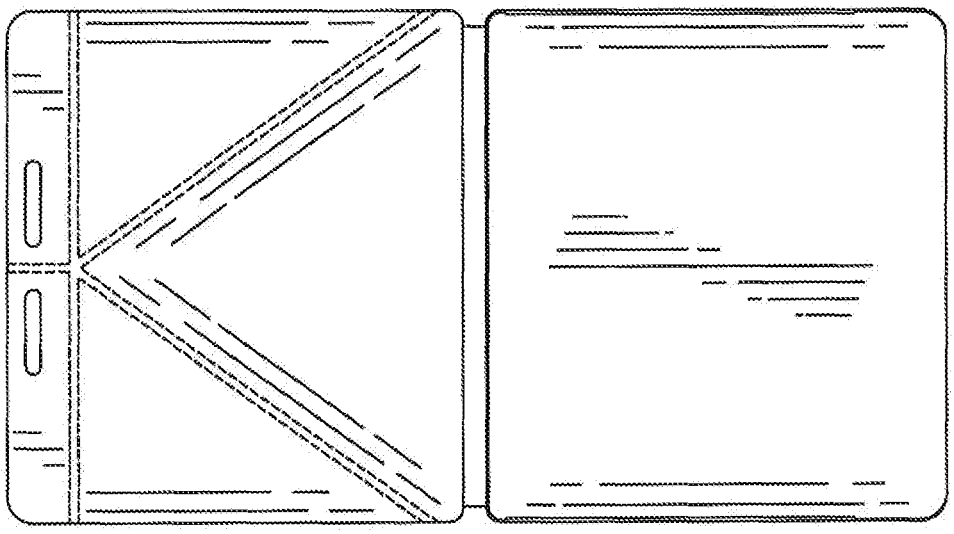
FIG. 30 depicts a perspective view of inner portions of a protective case according to one or more aspects of the disclosed subject matter.
Figure 31:
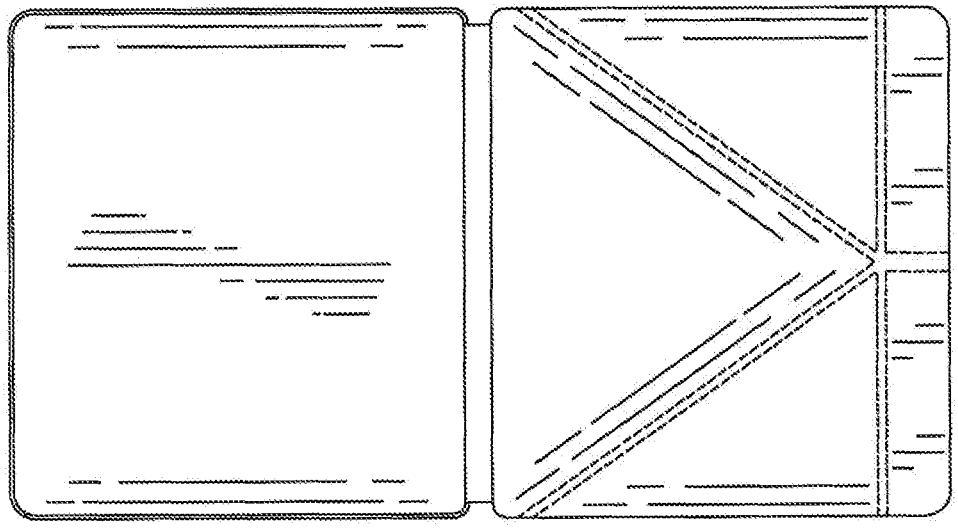
FIG. 31 depicts a perspective view of outer portions of a protective case according to one or more aspects of the disclosed subject matter.

FIGS. 30 and 31 show an exemplary embodiment. FIG. 30 depicts a perspective view of inner portions of a protective case, and FIG. 31 depicts a perspective view of outer portions of the protective case. In FIGS. 30 and 31, the case includes the device button recesses 628, but the first crease 612, the second crease 614, the third crease 616, and the fold 618 are optional.

Figure 32:
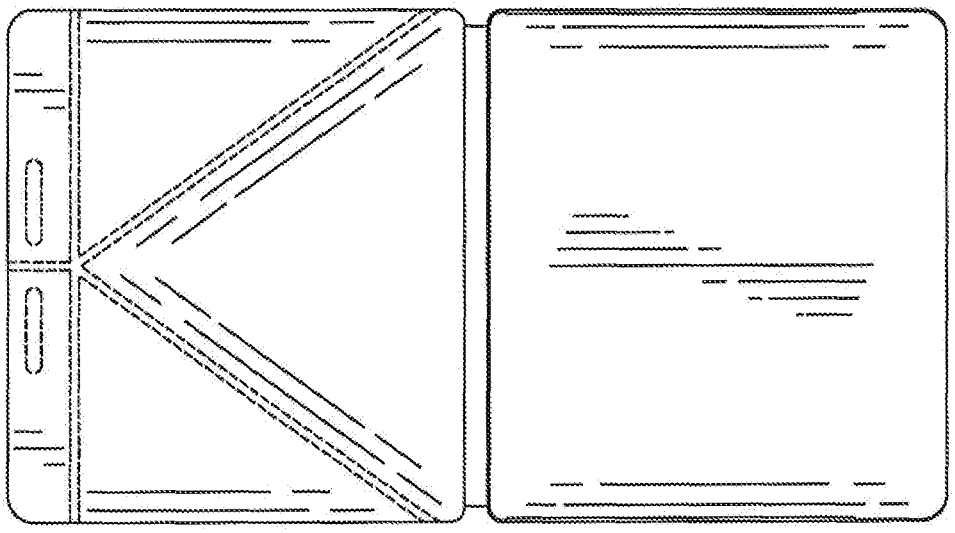
FIG. 32 depicts a perspective view of inner portions of a protective case according to one or more aspects of the disclosed subject matter.
Figure 33:
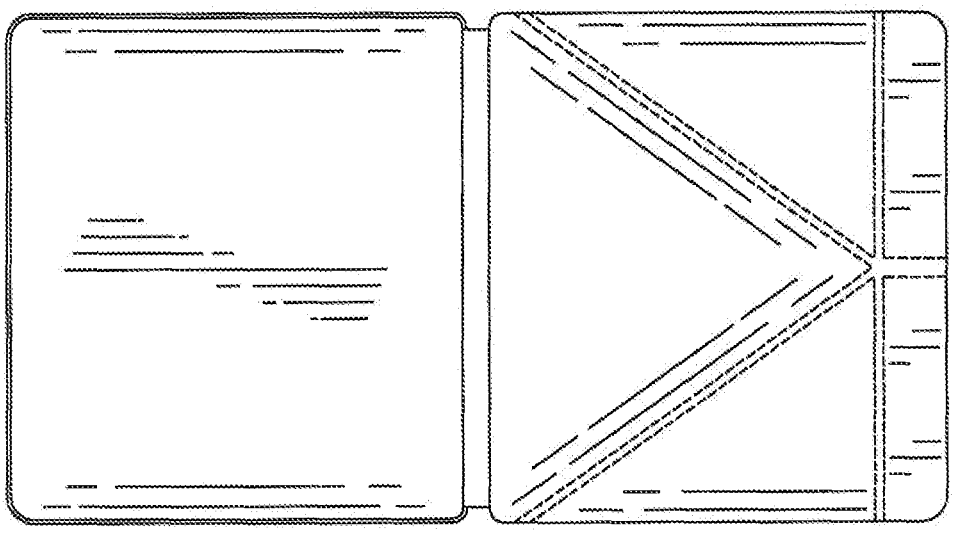
FIG. 33 depicts a perspective view of outer portions of a protective case according to one or more aspects of the disclosed subject matter.

FIGS. 32 and 33 show an exemplary embodiment. FIG. 32 depicts a perspective view of inner portions of a protective case, and FIG. 33 depicts a perspective view of outer portions of the protective case. In FIGS. 32 and 33, the device button recesses 628, the first crease 612, the second crease 614, the third crease 616, and the fold 618 are optional.

An exemplary embodiment is directed to a protective case 100. The protective case 100 including: a back cover 104 configured to secure an electronic reading device 624; and a front cover 102 connected to the back cover 104 by a hinge 106, wherein the front cover 102 is divided into a plurality of separate stiffener sections 602, 604, 606, 608, 610, etc. that are defined by a plurality of creases 612, 614, 616, 618, etc. and the plurality or creases 612, 614, 616, 618 are configured to allow movement of the plurality of stiffener sections so that the protective case 100 can be folded into a stand.

In an exemplary embodiment, the plurality of creases 612, 614, 616, 618 are four creases.

In an exemplary embodiment, the plurality of stiffener sections 602, 604, 606, 608, 610 are five stiffener sections.

In an exemplary embodiment, the five stiffener sections consist of a first stiffener section 602, a second stiffener section 604, a third stiffener section 606, a fourth stiffener section 608, and a fifth stiffener section 610, and the four creases consist of a first crease 612, a second crease 614, a third crease 616, and a fourth crease 618. The first stiffener section 602 is in a shape of a triangle, and is bordered by the first crease 612, the second crease 614, and the hinge 106. The second stiffener section 604 is in a form of a triangle, and is bordered by the first crease 612 and the third crease 616, and the second stiffener section 604 is smaller in area than the first stiffener section 602. The third stiffener section 606 is the same shape and size as the second stiffener section 604, but is a mirror image of the second stiffener section 604, and the third stiffener section 606 is bordered by the second crease 614 and the third crease 616.

In an exemplary embodiment, the fourth stiffener section 608 and the fifth stiffener section 610 form a flap at an end of the front cover 102 that is opposite the hinge 106.

In an exemplary embodiment, the fourth stiffener section 608 and the fifth stiffener section 610 are the same size and are mirror images of each other, and are separated by the fourth crease 618.

In an exemplary embodiment, the first crease 612, the second crease 614, the third crease 616, and the fourth crease 618 are each configured to fold to form a stand that allows an electronic reading device 624 to stand in multiple orientations.

In an exemplary embodiment, the first stiffener section 602 has a plurality of magnets 902 embedded therein, and the back cover 104 has a plurality of corresponding stand plates 904 embedded therein that are configured to interact with the plurality of magnets 902 when the front cover 102 is folded behind the back cover 104 to form a stand.

In an exemplary embodiment, the plurality of magnets 902 are three magnets and the plurality of stand plates 904 are three plates.

In an exemplary embodiment, the front cover 102 includes one or more closure magnets 620 embedded therein that are configured to interact with corresponding one or more device magnets 626 that are embedded in the electronic reading device 624 when it is secured by the back cover 104. When the front cover 102 is closed, the one or more closure magnets 620 are in direct alignment with the one or more corresponding device magnets 626 to keep the cover closed.

In an exemplary embodiment, the one or more closure magnets 620 are two closure magnets 620 and a first closure magnet 620 is located in the fourth stiffener section 608, and a second closure magnet 620 is located in the fifth stiffener section 610.

In an exemplary embodiment, the back cover 104 has one or more back cover plates 906 embedded therein that are configured to interact with the one or more closure magnets 620 when the front cover 102 is folded behind the back cover 104.

In an exemplary embodiment, an inner side of the front cover 106 has two device button recesses 628 that are configured to accommodate raised buttons on a front surface of an electronic reading device 624. A first device button recess 628 is located in the fourth stiffener section 608 and a second device button recess 628 is located in the fifth stiffener section 610.

In an exemplary embodiment, each of the plurality of stiffener sections is an injection molded polycarbonate material.

In an exemplary embodiment, the front cover 104 has an embedded Hall sensor magnet 908 that is configured to interact with a Hall sensor in an electronic reading device 624 causing the electronic reading device 624 to enter a sleep mode.

In an exemplary embodiment, the back cover 104 includes a hard plastic shell.

In an exemplary embodiment, the fourth stiffener section 608 and the fifth stiffener section 610 are in the shape of a rectangle, but with one corner rounded off.

An exemplary embodiment is directed to a method for folding a protective case 100 into a stand. The protective case including a front cover 102 connected to a back cover 104 by a hinge 106. The front cover 102 is divided into a first stiffener section 602, a second stiffener section 604, a third stiffener section 606, a fourth stiffener section 608, and a fifth stiffener section 610 that are defined by a first crease 612, a second crease 614, a third crease 616, and a fourth crease 618. The first stiffener section 602 is in a shape of a triangle, and is bordered by the first crease 612, the second crease 614, and the hinge 106. The second stiffener section 604 is in a form of a triangle, and is bordered by the first crease 612 and the third crease 616, and the second stiffener section 604 is smaller in area than the first stiffener section 602. The third stiffener section 606 is the same shape and size as the second stiffener section 604, but is a mirror image of the second stiffener section 604, and the third stiffener section 606 is bordered by the second crease 614 and the third crease 616. The fourth stiffener section 608 and the fifth stiffener section 610 form a flap at an end of the front cover 102 that is opposite the hinge 106, and the fourth stiffener section 608 and the fifth stiffener section 610 are the same size and are mirror images of each other, and are separated by the fourth crease 618. The first stiffener section 602 has a plurality of magnets 902 embedded therein, and the back cover 104 has a plurality of corresponding stand plates 904 embedded therein. A first closure magnet 620 is located in the fourth stiffener section 608, and a second closure magnet 620 is located in the fifth stiffener section 610. The method including: folding the front cover 102 backwards about the hinge 106 so that each of the plurality of magnets 902 in the first stiffener section 602 interact with a corresponding stand plate 904 in the back cover 104 so that the first stiffener section 602 is secured against the back cover 104; moving the second stiffener section 604 about the first crease 612 and moving the third stiffener section 606 about the second crease 614; moving the fourth stiffener section 608 about the fourth crease 618 and moving the fifth stiffener section 610 about the fourth crease 618 so that the first closure magnet 620 is aligned and interacts with the second closure magnet 620.

In an exemplary embodiment, a number of the plurality of magnets 902 is three.

In an exemplary embodiment, an edge of the second stiffener section 604 that is in contact with the third crease 616 and an edge of the third stiffener section 606 that is in contact with the third crease 616 are in contact with each other and held together by the first and second closure magnets 620.

An exemplary embodiment is directed to a protective case 100. The protective case 100 including: a back cover 104 configured to secure an electronic reading device 624; and a front cover 102 connected to the back cover 104 by a hinge 106. The front cover 102 is divided into a first stiffener section 602, a second stiffener section 604, a third stiffener section 606, a fourth stiffener section 608, and a fifth stiffener section 610 that are defined by a first crease 612, a second crease 614, a third crease 616, and a fourth crease 618. The first stiffener section 602 is in a shape of a triangle, and is bordered by the first crease 612, the second crease 614, and the hinge 106. The second stiffener section 604 is in a form of a triangle, and is bordered by the first crease 612 and the third crease 616, and the second stiffener section 604 is smaller in area than the first stiffener section 602. The third stiffener section 606 is the same shape and size as the second stiffener section 604, but is a mirror image of the second stiffener section 604, and the third stiffener section 606 is bordered by the second crease 614 and the third crease 616. The fourth stiffener section 608 and the fifth stiffener section 610 form a flap at an end of the front cover 102 that is opposite the hinge 106, and the fourth stiffener section 608 and the fifth stiffener section 610 are the same size and are mirror images of each other, and are separated by the fourth crease 618. An outer side of the front cover 110 has a gap 1902 that is located between an angled edge 1904 of the fourth stiffener section 608 and an angled edge 1904 of the fifth stiffener section 610.

In an exemplary embodiment, the angled edge 1904 of the fourth stiffener section 608 and the angled edge 1904 of the fifth stiffener section 610 each have an angle between 30 and 60 degrees relative to the vertical when the entire front cover 102 is parallel to the ground.

In an exemplary embodiment, the angle is 45 degrees relative to the vertical.

In an exemplary embodiment, the angled edge 1904 of the fourth stiffener section 608 and the angled edge 1904 of the fifth stiffener section 610 prevent complete folding of the fourth stiffener section 608 and the fifth stiffener section 610 when outer surfaces of the fourth stiffener section 608 and the fifth stiffener section 610 are moved towards each other about the fourth crease 618.

In an exemplary embodiment, an inner side of the front cover 108 has a gap 1802 that is located in between the fourth stiffener section 608 and the fifth stiffener section 610, and the gap 1802 on the inner side of the front cover 108 is narrower than the gap 1902 on the outer side of the front cover 110.

In an exemplary embodiment, the gap 1802 on the inner side of the front cover is configured to permit the fourth stiffener section 608 and the fifth stiffener section 610 to rotate about the fourth crease 618 and contact each other.

In an exemplary embodiment, the first stiffener section 602 has a plurality of magnets 902 embedded therein, and the back cover 104 has a plurality of corresponding stand plates 904 embedded therein.

In an exemplary embodiment, a first closure magnet 620 is located in the fourth stiffener section 608, and a second closure magnet 620 is located in the fifth stiffener section 610.

In an exemplary embodiment, an inner side of the front cover 108 is covered with a microfiber material.

In an exemplary embodiment, the outer side of the front cover 110 is covered with polyurethane (PU) leather.

In an exemplary embodiment, an outer side of the back cover 114 is covered with PU leather.

In an exemplary embodiment, an inner side of the back cover 104 includes a plurality of indentations for weight reduction.

In an exemplary embodiment, the plurality of indentations form a honeycomb structure.

In an exemplary embodiment, the back cover 104 is non-foldable.

Having now described embodiments of the disclosed subject matter, it should be apparent to those skilled in the art that the foregoing is merely illustrative and not limiting, having been presented by way of example only. Thus, although particular configurations have been discussed herein, other configurations can also be employed. Numerous modifications and other embodiments (e.g., combinations, rearrangements, etc.) are enabled by the present disclosure and are within the scope of one of ordinary skill in the art and are contemplated as falling within the scope of the disclosed subject matter and any equivalents thereto. Features of the disclosed embodiments can be combined, rearranged, omitted, etc., within the scope of the invention to produce additional embodiments. Furthermore, certain features may sometimes be used to advantage without a corresponding use of other features. Accordingly, Applicant(s) intend(s) to embrace all such alternatives, modifications, equivalents, and variations that are within the spirit and scope of the disclosed subject matter.

The invention claimed is:

1. A protective case, comprising:

a back cover configured to secure an electronic reading device; and a front cover connected to the back cover by a hinge, wherein the front cover is divided into a first stiffener section, a second stiffener section, a third stiffener section, a fourth stiffener section, and a fifth stiffener section that are defined by a first crease, a second crease, a third crease, and a fourth crease, wherein the first stiffener section is in a shape of a triangle, and is bordered by the first crease, the second crease, and the hinge, wherein the second stiffener section is in a form of a triangle, and is bordered by the first crease and the third crease, and the second stiffener section is smaller in area than the first stiffener section, wherein the third stiffener section is the same shape and size as the second stiffener section, but is a mirror image of the second stiffener section, and the third stiffener section is bordered by the second crease and the third crease, wherein the fourth stiffener section and the fifth stiffener section form a flap at an end of the front cover that is opposite the hinge, and the fourth stiffener section and the fifth stiffener section are the same size and are mirror images of each other, and are separated by the fourth crease, and wherein an outer side of the front cover has a gap that is located between an angled edge of the fourth stiffener section and an angled edge of the fifth stiffener section, wherein the angled edge of the fourth stiffener section and the angled edge of the fifth stiffener section each have an angle between 30 and 60 degrees relative to the vertical when the entire front cover is parallel to the ground.

2. The protective case of claim 1, wherein the angle is 45 degrees relative to the vertical.

3. The protective case of claim 1, wherein the angled edge of the fourth stiffener section and the angled edge of the fifth stiffener section prevent complete folding of the fourth stiffener section and the fifth stiffener section when outer surfaces of the fourth stiffener section and the fifth stiffener section are moved towards each other about the fourth crease.

4. The protective case of claim 3, wherein an inner side of the front cover has a gap that is located in between the fourth stiffener section and the fifth stiffener section, and wherein the gap on the inner side of the front cover is narrower than the gap on the outer side of the front cover.

5. The protective case of claim 4, wherein the gap on the inner side of the front cover is configured to permit the fourth stiffener section and the fifth stiffener section to rotate about the fourth crease and contact each other.

6. The protective case of claim 1, wherein the first stiffener section has a plurality of magnets embedded therein, and the back cover has a plurality of corresponding stand plates embedded therein.

7. The protective case of claim 1, wherein a first closure magnet is located in the fourth stiffener section, and a second closure magnet is located in the fifth stiffener section.

8. The protective case of claim 1, wherein an inner side of the front cover is covered with a microfiber material.

9. The protective case of claim 1, wherein the outer side of the front cover is covered with polyurethane (PU) leather.

10. The protective case of claim 1, wherein an outer side of the back cover is covered with PU leather.

11. The protective case of claim 1, wherein an inner side of the back cover includes a plurality of indentations for weight reduction.

12. The protective case of claim 11, wherein the plurality of indentations form a honeycomb structure.

13. The protective case of claim 1, wherein the back cover is non-foldable.

* * * * *